US008396236B2

(12) United States Patent
Pape et al.

(10) Patent No.: US 8,396,236 B2
(45) Date of Patent: Mar. 12, 2013

(54) METHOD FOR COMPENSATING FOR A FEEDBACK SIGNAL, AND HEARING DEVICE

(75) Inventors: Sebastian Pape, Erlangen (DE); Stefan Petrausch, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 213 days.

(21) Appl. No.: 13/023,812

(22) Filed: Feb. 9, 2011

(65) Prior Publication Data

US 2011/0194715 A1 Aug. 11, 2011

(30) Foreign Application Priority Data

Feb. 9, 2010 (DE) ..... 10 2010 007 336

(51) Int. Cl.
*H04R 25/00* (2006.01)

(52) U.S. Cl. ..... 381/318; 381/312; 381/317

(58) Field of Classification Search ..... 381/312, 381/316–318, 320–321
See application file for complete search history.

(56) References Cited

U.S. PATENT DOCUMENTS

| | | | | |
|---|---|---|---|---|
| 8,045,738 | B2 * | 10/2011 | Sira | 381/318 |
| 8,116,473 | B2 * | 2/2012 | Salvetti et al. | 381/318 |
| 2005/0096002 | A1 | 5/2005 | Klinke et al. | |
| 2007/0094319 | A1 | 4/2007 | Behrens et al. | |
| 2007/0297627 | A1 | 12/2007 | Puder | |

FOREIGN PATENT DOCUMENTS

| | | | |
|---|---|---|---|
| DE | 10162559 | A1 | 7/2003 |
| DE | 10 2006 029 194 | A1 | 12/2007 |
| WO | 2004079901 | A2 | 9/2004 |

OTHER PUBLICATIONS

Maxwell et al,"Reducing Acoustic Feedback in Hearing Aids", IEEE Transactions on Speech and Audio Processing, IEEE Service Center, New York, US, vol. 3, No. 4, Jul. 1995, pp. 304-314, ISSN: 1063-6676, XP000633074.

* cited by examiner

*Primary Examiner* — Suhan Ni
(74) *Attorney, Agent, or Firm* — Laurence A. Greenberg; Werner H. Stemer; Ralph E. Locher

(57) ABSTRACT

Feedback in a hearing device and, more particularly, in a hearing aid should be compensated for before it becomes audible. To this end, a method is proposed for compensating for a feedback signal in a hearing device with an input-transducer apparatus, a signal-processing apparatus and an output-transducer apparatus, in which method a feedback signal is compensated for, which feedback signal is fed back to the input-transducer apparatus from the output-transducer apparatus or the signal-processing apparatus. More particularly, a probability of having a plurality of notches, equally spaced apart from one another, in the spectrum of an input signal is established, which input signal originates directly from the input-transducer apparatus or which is a difference signal between the signal directly from the input-transducer apparatus and a compensation signal serving for compensation. The compensation is modified or the signal-processing apparatus is amplified as a function of this established probability.

9 Claims, 7 Drawing Sheets

METHOD FOR COMPENSATING FOR A FEEDBACK SIGNAL, AND HEARING DEVICE

CROSS-REFERENCE TO RELATED APPLICATION

This application claims the priority, under 35 U.S.C. §119, of German application DE 10 2010 007 336.9, filed Feb. 9, 2010; the prior application is herewith incorporated by reference in its entirety.

BACKGROUND OF THE INVENTION

Field of the Invention

The present invention relates to a method for compensating for a feedback signal in a hearing device with an input-transducer apparatus, a signal-processing apparatus and an output-transducer apparatus, by compensating for a feedback signal, which is fed back to the input-transducer apparatus from the output-transducer apparatus or the signal-processing apparatus. Moreover, the present invention relates to a corresponding hearing device. Here a hearing device is understood to mean any instrument that can be worn in or on the head and emits sound, more particularly a hearing aid, a headset, headphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing unit. This basic configuration is illustrated in FIG. 1 using the example of a behind-the-ear hearing aid. One or more microphones 2 for recording the sound from the surroundings are installed in a hearing aid housing 1 to be worn behind the ear. A signal-processing unit 3, likewise integrated into the hearing aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5 likewise integrated into the hearing aid housing 1 supplies the hearing aid and in particular the signal-processing unit 3 with energy.

One of the greatest problems of hearing aids is the occurrence of feedback, which is often expressed as feedback whistling. Here, the sound leaving the loudspeaker of the hearing aid finds an acoustic feedback path to the microphones and is amplified again, leading to the typical whistling or resonance effects. Modern hearing systems are able to match the feedback path to the facial expression of the user and to compensate for the feedback signal in an appropriate fashion; the corresponding unit of the hearing system is called a feedback compensator.

As will be illustrated below, an adaptive filter (the feedback compensator) simulates the acoustic feedback path by minimizing the energy after the subtraction point. The problem here is that the desired signal or useful signal forms the unwanted signal from the point of view of the feedback compensator. Moreover, the useful signal is usually strongly correlated with the feedback signal as a result of the amplification caused by the hearing aid, and so it is almost impossible to distinguish between the feedback signal and the useful signal.

Hence, it is very important to set the adaptation speed for the feedback path correctly. If the adaptation is too slow, feedback whistling is audible for a certain period of time. If the adaptation is too fast, this results in so-called musical artifacts, i.e. the feedback compensator attempts to suppress the useful signal. Feedback detectors are often required for the correct adaptation speed. Moreover, the performance of the feedback detector is very important for the performance of the entire feedback compensator.

A typical configuration of a feedback compensator in a hearing aid with a feedback detector is illustrated in FIG. 2. A microphone 10 records a sound signal and transmits it to a signal-processing apparatus 11. The output signal resulting from the signal-processing apparatus 11 is transmitted to an output transducer or loudspeaker 12. The sound 13 leaving the loudspeaker partly advances to the eardrum or ear, and the other part is fed back as feedback signal 14 to the microphone 10 via the respectively current feedback path 15. The feedback sound is added to the useful signal 16, and the sum provides the acoustic input signal for the microphone 10.

The signal-processing apparatus 11 has a conventional signal processor 17 and a feedback compensator 18. Provision is moreover made for a feedback detector 19. The output signal from the signal processor 17 is fed to both the loudspeaker 12 and the feedback compensator 18. The latter simulates the feedback path and supplies a corresponding compensation signal, which is subtracted from the signal from the microphone 10 by a subtractor 20. The resulting signal is provided as an input signal to the signal processor 17. The signal is moreover used for generating the feedback signal in the feedback compensator 18.

The signal 30 from the microphone 10 and the difference signal 40 after the subtractor 20 are fed to the feedback detector 19, which determines whether or not there is a feedback situation. The feedback compensator 18 and, if need be, the signal processor 17 as well are controlled as a function of this decision. The feedback compensator 18 often is an adaptive filter, which attempts to simulate the acoustic feedback path. Ideally, the feedback compensator 18 filters the output signal from the signal processor 17 like the acoustic feedback path 15. This leads to a complete suppression of the feedback signal 14 at the subtractor 20. However, the feedback compensator 18 is often mismatched or simply too slow for the rapid change in the feedback path. Hence, there often is the need for one or more feedback detectors 19 for adapting the adaptation speed of the feedback compensator 18. These feedback detectors 19 usually analyze either the microphone signal 30 before the subtractor 20 or the compensated signal 40 after the subtractor 20, which compensated signal should be without feedback. As already indicated above, the signal processor 17 can likewise be influenced such that feedback whistling is avoided, for example by reducing the amplification.

The now described detection methods are used in current feedback detectors.

1. Channel-Level-Based Detection.

Comparing the signal levels in different frequency channels allows feedback whistling to be detected by either searching for level peaks or classifying certain levels in particular frequency bands as feedback.

2. Detection Based on Sinusoidal Signal Components.

There are a number of methods for detecting sinusoidal signal components. If a sinusoidal signal component is detected in a feedback-critical frequency range, this indicates feedback.

3. Detection of a Phase Modulation.

The best method for detecting feedback is the detection of a phase modulation or frequency modulation to which the output signal from the hearing aid loudspeaker was subjected. In the process, the output-signal phase is modulated by a low, inaudible frequency. If precisely this frequency is detected at the input (microphone) as a phase modulation, it is a feedback signal in all probability. This method is the most robust feedback-detection method; in particular also in respect of false detections of the useful signal.

A problem in all these approaches is that there needs to be a high level of feedback whistling in order to be able to detect the feedback at all. The detection of the phase modulation also requires an input signal with a stable phase (a sinusoidal signal) in order to detect a modulation of this phase. This means that feedback whistling is necessary for suppressing the latter. None of the above methods are able to avoid the whistle in its entirety.

SUMMARY OF THE INVENTION

It is accordingly an object of the invention to provide a method for compensating for a feedback signal, and a hearing device which overcome the above-mentioned disadvantages of the prior art methods and devices of this general type, which recognizes a feedback situation as quickly as possible and, if need be, taking appropriate compensation steps. To this end, provision should be made for a corresponding method and a corresponding hearing device.

According to the invention, the object is achieved by a method for compensating for a feedback signal in a hearing device having an input-transducer apparatus, a signal-processing apparatus and an output-transducer apparatus. The method includes:

a) compensating for a feedback signal, which is fed back to the input-transducer apparatus from the output-transducer apparatus or the signal-processing apparatus by establishing a probability of having a plurality of notches, equally spaced apart from one another, in the spectrum of an input signal, which originates directly from the input-transducer apparatus or which is a difference signal between the signal directly from the input-transducer apparatus and a compensation signal serving for compensation; and b) modifying the compensation or an amplification of the signal-processing apparatus as a function of the established probability.

Moreover, according to the invention, provision is made for a hearing device. The hearing device includes an input-transducer apparatus, a signal-processing apparatus for processing the input signal emitted by the input-transducer apparatus to form an output signal, an output-transducer apparatus for converting the output signal into an acoustic output signal, and a compensation apparatus for compensating for a feedback signal, which is fed back to the input-transducer apparatus from the output-transducer apparatus or the signal-processing apparatus. A detection apparatus is provided for establishing a probability of the spectrum of the input signal having a plurality of notches, equally spaced apart from one another. The compensation apparatus can be controlled in dependence on an established probability.

In this case, "establishing a probability" is also understood to mean the "detection" (i.e. 100% probability) of notches (peaked minima). Thus, a feedback situation can advantageously be recognized simply by virtue of the fact that equally spaced-apart notches are detected in the transfer function and their distance to a transfer function is determined in the case of compensated feedback. Corresponding compensation can then be initiated as a function thereof, without feedback whistling having already occurred.

The probability is preferably established in a pause in the speech during the intended operation of the hearing device. This is because there generally is no useful signal, which could adversely affect the adaptation and the detection, during a pause in the speech.

The transfer function from the input signal to the output signal can correspond to a comb filter. If the feedback signal is taken into account, this then results in a constant transfer function for the useful signal.

Furthermore, the probability can be established in a noisy frequency range of the input signal. This generally provides a broadband input-signal, in which numerous notches are able to develop clearly.

The feedback signal can be verified by virtue of the fact that the output signal is frequency modulated or phase modulated and the notches are analyzed in respect of the frequency modulation or phase modulation. This can increase the reliability of the decision relating to the presence of a feedback situation.

The compensation is advantageously brought about by an adaptive filter and the adaptation speed is modified in dependence on the established probability.

More particularly, the compensation can be modified to the effect that the transfer function of a compensated signal, created by mixing the input signal with a compensation signal for compensating for the feedback signal, to the output signal is substantially without a gradient in the greatest part of a prescribed spectral range, which should be influenced by the compensation. If this is the case, an ideal compensation of the feedback signal has been achieved.

Other features which are considered as characteristic for the invention are set forth in the appended claims.

Although the invention is illustrated and described herein as embodied in a method for compensating for a feedback signal, and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments explained in more detail below constitute preferred embodiments of the invention.

Figure 1:
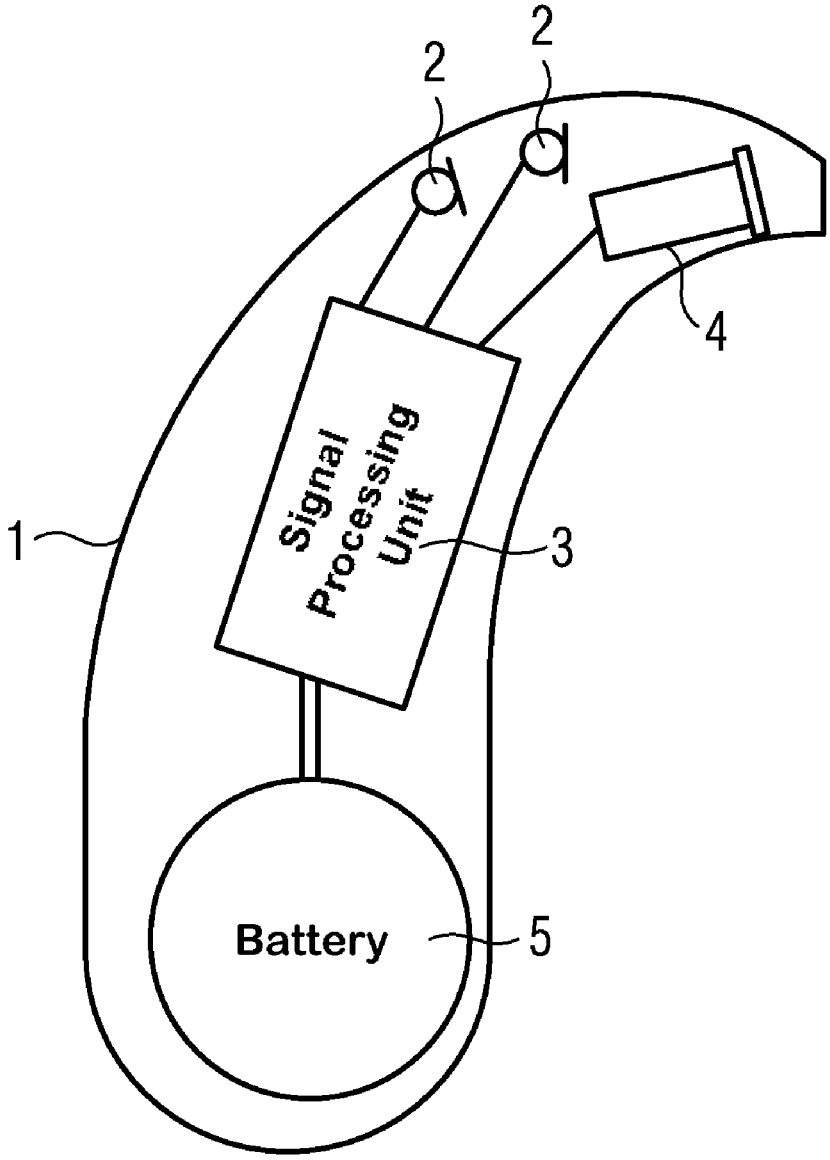
FIG. 1 PRIOR ART
FIG. 1 is a diagrammatic illustration of a hearing aid according to the prior art.
Figure 2:
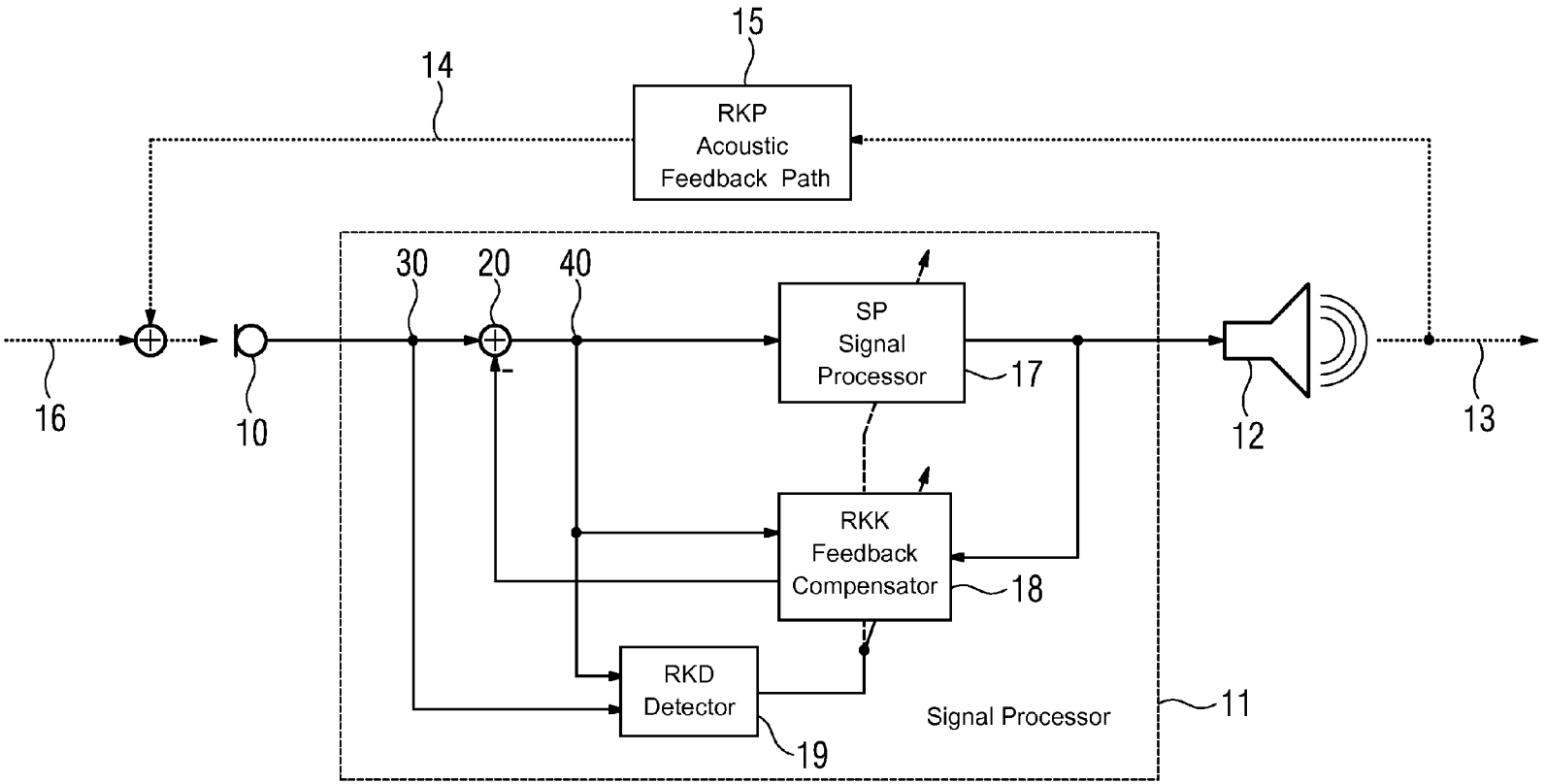
FIG. 2 PRIOR ART
FIG. 2 is a block diagram of the hearing aid according to the prior art.
Figure 3:
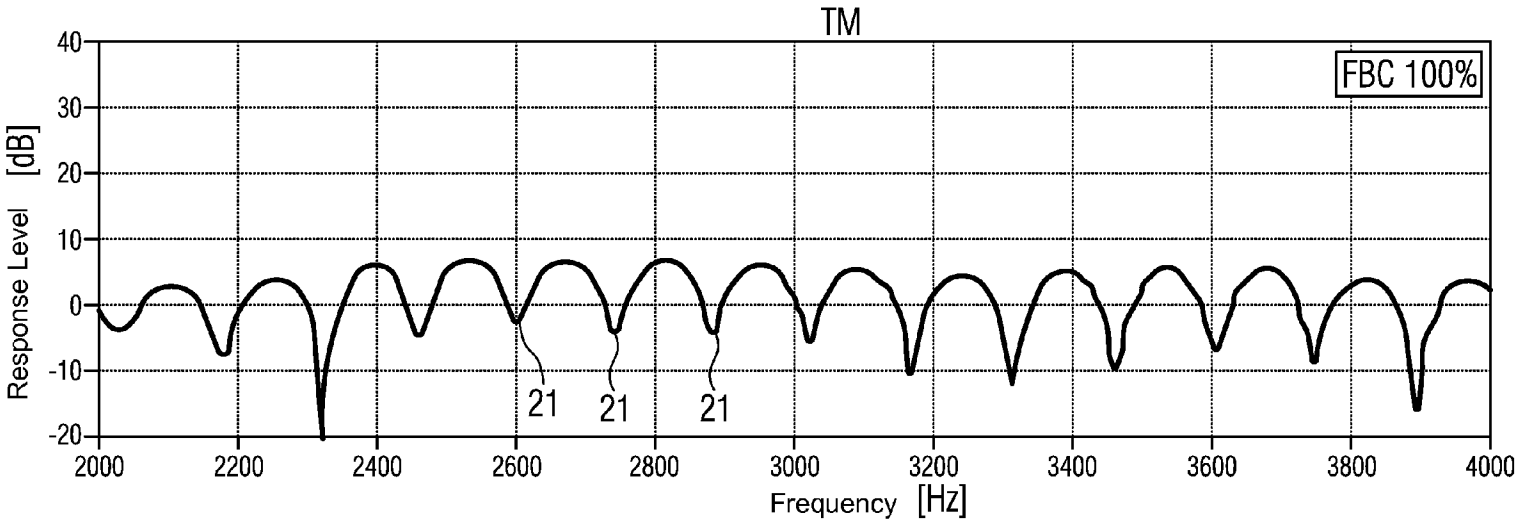
FIG. 3 is a graph showing a transfer function of a microphone signal at 100% compensation.
Figure 4:
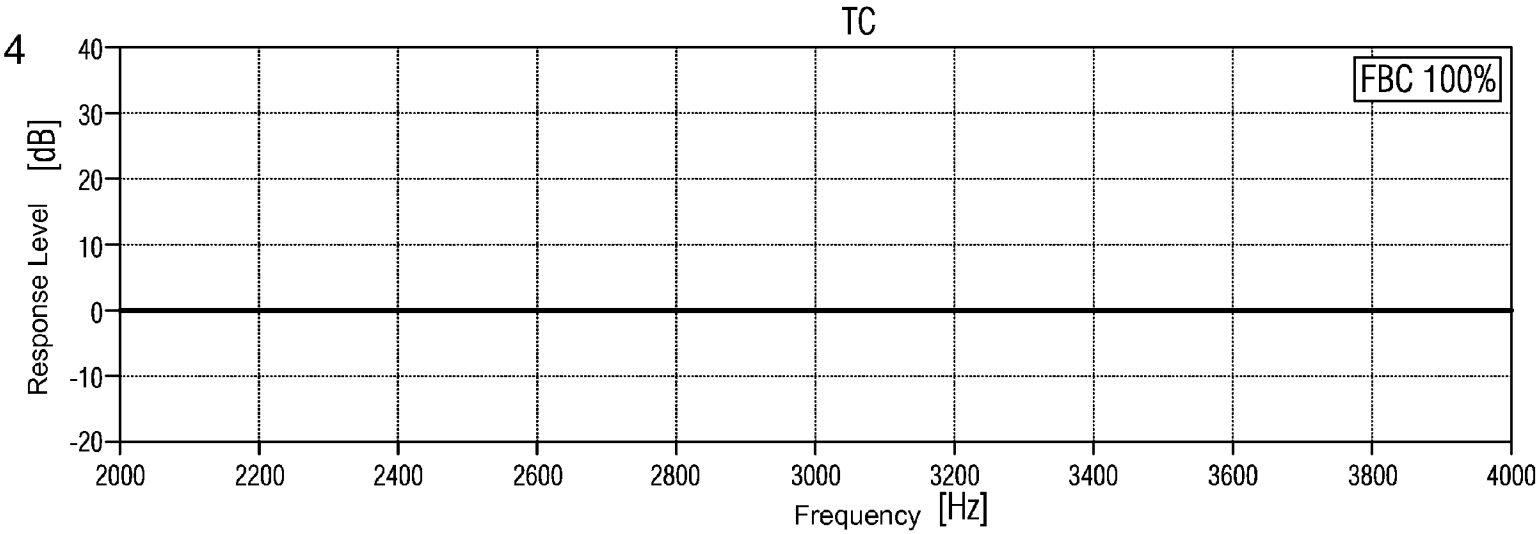
FIG. 4 is a graph showing a transfer function of a compensated signal at 100% compensation.

The basic approach of the present invention consists of being able to detect a mismatch with respect to the feedback path without there being an audible feedback whistling. The invention utilizes the comb-filter effect, which is based on the superposition of a useful signal with a feedback signal. If two correlated signals are added with a small delay, this leads to destructive or constructive superposition, and notches or peaks can be identified in the frequency response (compare FIG. 3). If the feedback compensator (FBC) is adapted in an ideal fashion (100% compensation), the transfer function TM of the microphone signal 30, originating from the microphone 10 (compare FIG. 2), is a finite impulse response from a comb filter with a typical distribution of approximately equally spaced-apart notches 21. The transfer function TC of the compensated signal 40 to the compensated output signal is ideally completely flat, as illustrated in FIG. 4. It has no gradient and is constant over the entire observed frequency range (between 2000 and 4000 Hz in this case).

Figure 5:
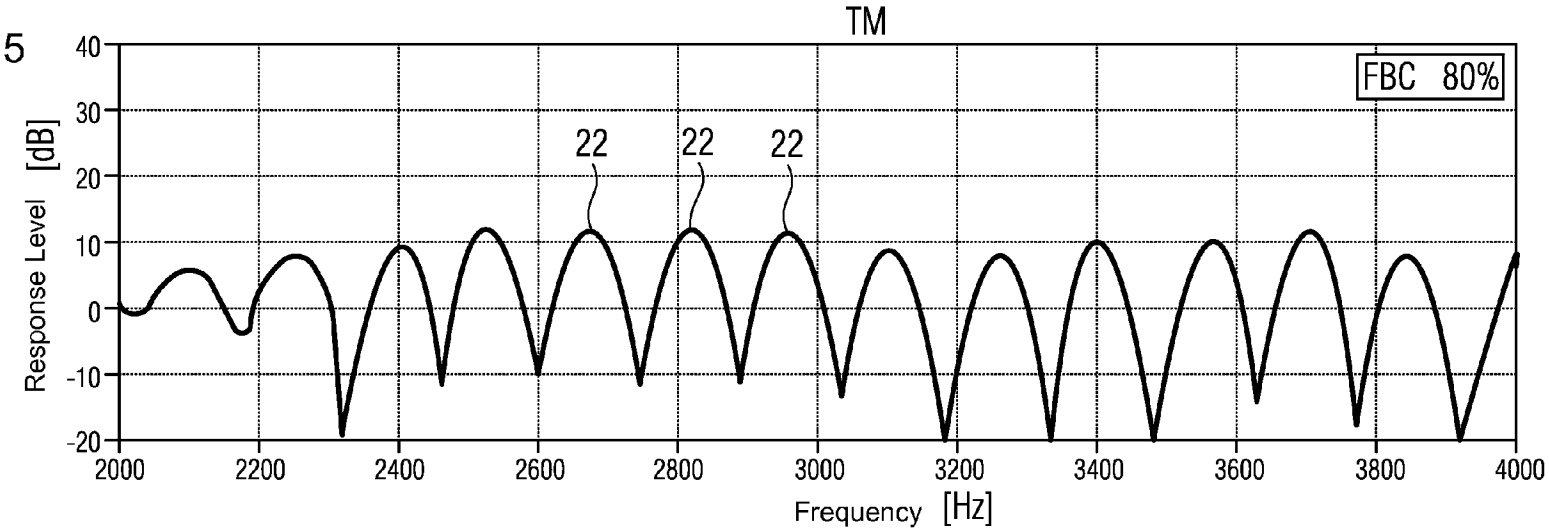
FIG. 5 is a graph showing a transfer function of the microphone signal at 80% compensation.
Figure 6:
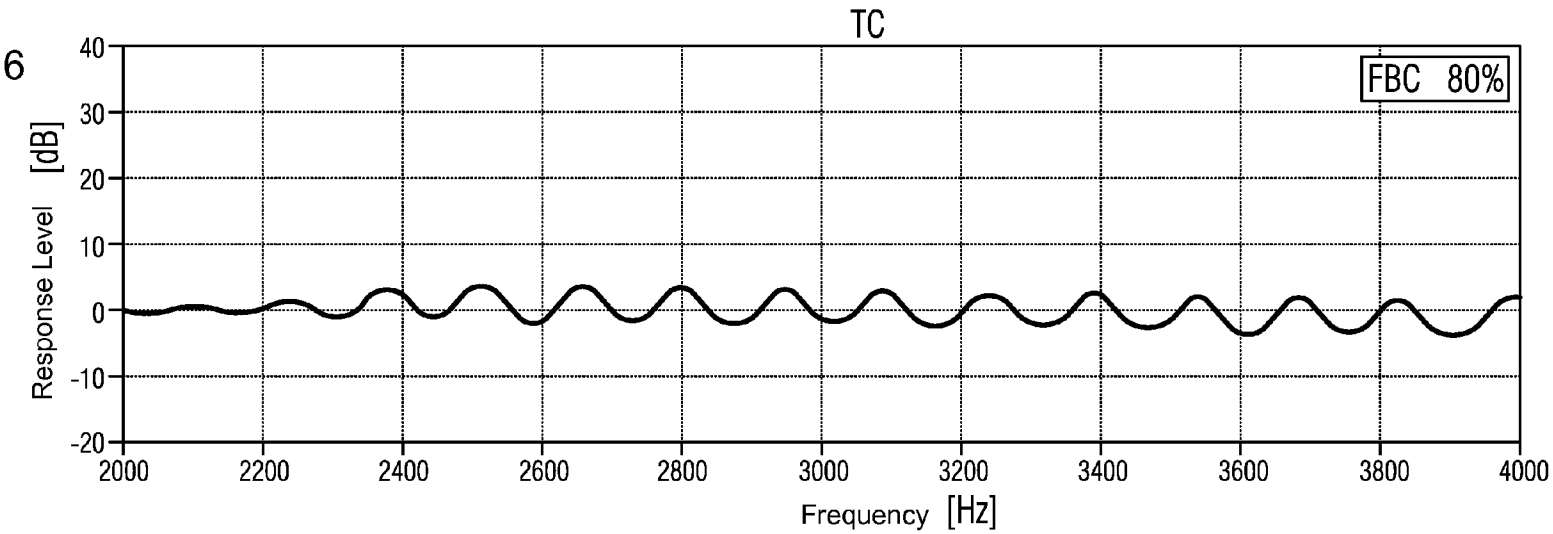
FIG. 6 is a graph showing a transfer function of a compensated signal at 80% compensation.

If, on the other hand, the feedback compensator 18 has been mismatched, the transfer function TM of the microphone signal 16 to the output signal 13 is an infinite impulse response from a comb filter with a typical distribution with significant frequency peaks. The feedback compensation is at 80% in FIGS. 5 and 6. Thus, there is a mismatch of 20%. Compared to the image in FIG. 3, the frequency peaks 22 in the transfer function TM of the microphone signal 30 to the output signal 13 are already slightly developed in FIG. 5. This mismatch leads to the transfer function TC of the compensated signal to the output signal 13 no longer being completely flat, as indicated in FIG. 6.

Figure 7:
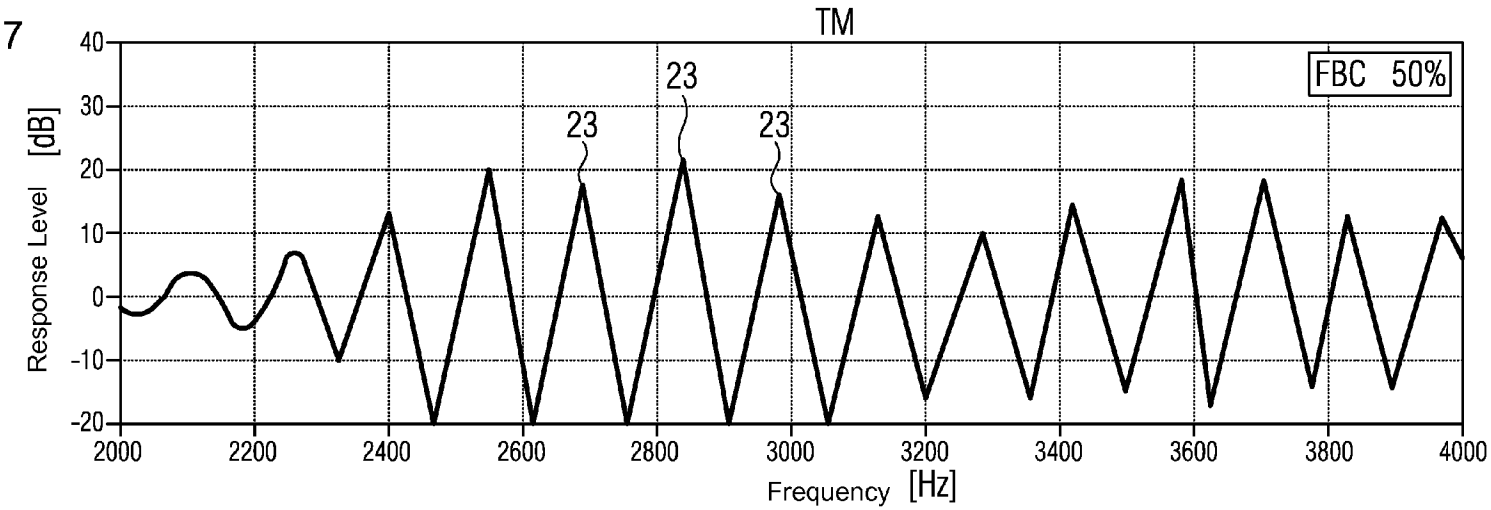
FIG. 7 is a graph showing a transfer function of a microphone signal at 50% compensation.
Figure 8:
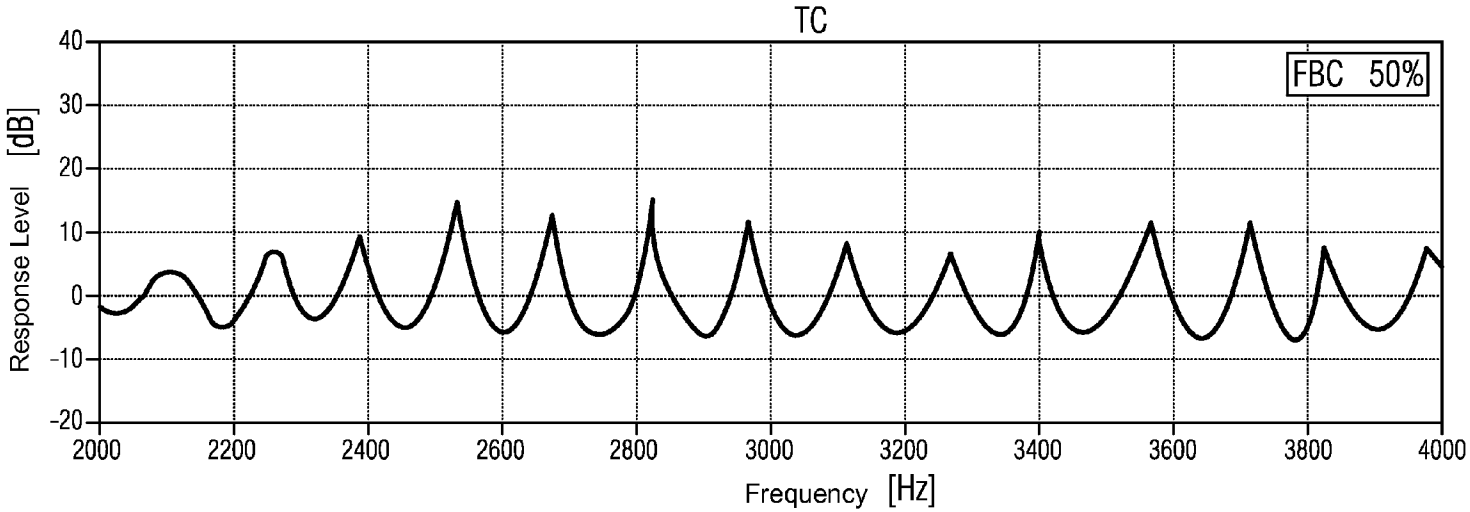
FIG. 8 is a graph showing a transfer function of a compensated signal at 50% compensation.

If there is a further increase in the mismatch, the transfer functions as per FIGS. 7 and 8 result in the case of a compensation of 50%. The equally spaced-apart frequency peaks 23 can now be clearly identified in FIG. 7, i.e. there are clear constructive superpositions of the feedback signal 14 and the useful signal 16 in the frequency ranges of the frequency peaks 23.

Figure 9:
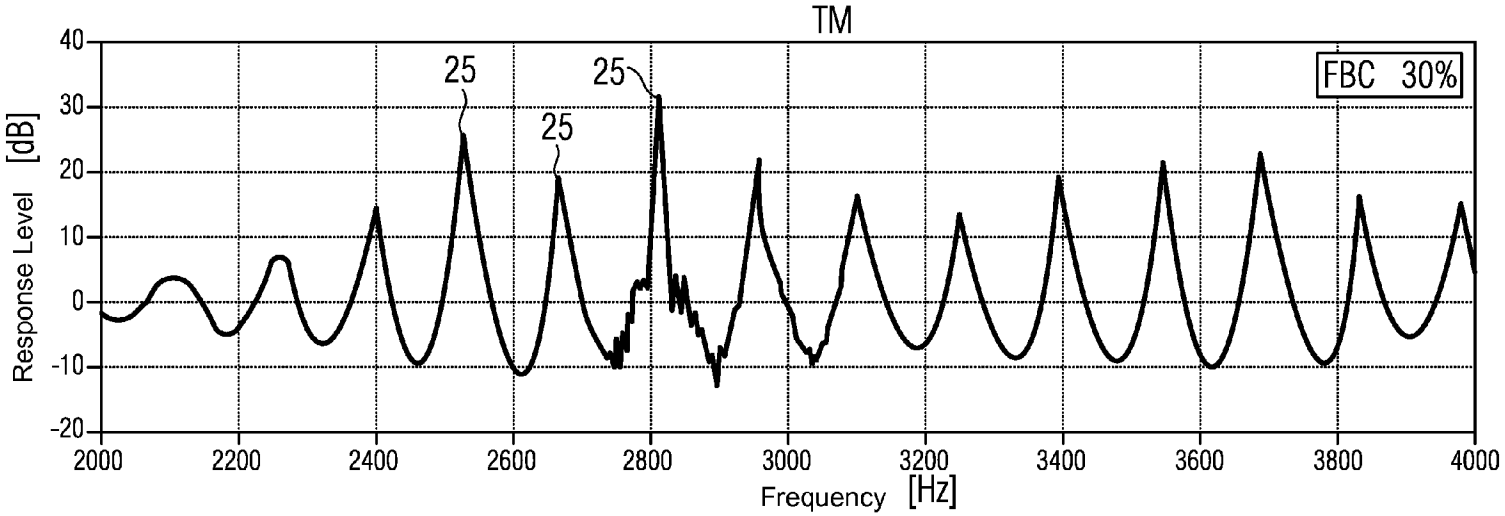
FIG. 9 is a graph showing a transfer function of a microphone signal at 30% compensation.
Figure 10:
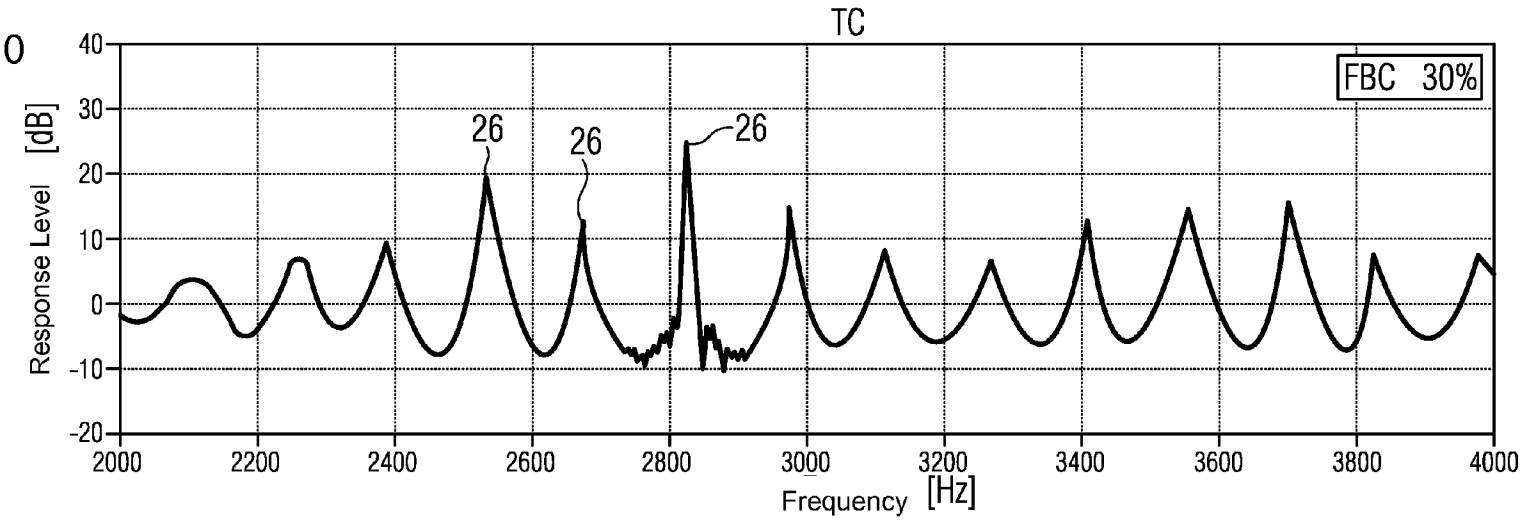
FIG. 10 is a graph showing a transfer function of the compensated signal with 30% compensation.

If the mismatch increases further, and the feedback compensation for example now is only 30%, this results in the transfer functions in FIGS. 9 and 10. Clearly developed frequency peaks 25 can now be identified in the transfer function TM of the microphone signal. The transfer function TC of the compensated signal 40 then likewise has significant peaks 26, which are likewise equally spaced apart from one another.

Therefore, if there is complete feedback compensation (100%), there are notches in the transfer function TM of the microphone signal 30 and the transfer function TC of the compensated signal 40 is completely flat, i.e. the feedback has been perfectly compensated for. The smaller the degree of compensation becomes, the more peaks can be identified in the transfer functions, which peaks exceed the function mean. These peaks are an indication that feedback whistling will occur or has already occurred. Hence, the advantage of the comb-filter effect is that the reduction in the degree of compensation from 100% to 0% can easily be identified in the transfer functions.

FIGS. 3 to 10 show that the transfer function TM from the microphone signal 30 is primarily affected by notches 21 (minima with respect to the function mean) at 100% compensation, while the transfer function is mainly affected by frequency peaks 26 (maxima with respect to the function mean) at low compensation (30%). There is a smooth transition between the notch-affected transfer function and the peak-affected transfer function. The transition can be observed without audible artifacts having already occurred. The basic idea of the present invention is based on this.

The problem occurring when utilizing this effect is that it is only possible to observe the response level of the microphone signal 16 or the response level of the compensated output signal 13, but not the transfer function TM of the microphone signal 30. This means that all that is obtained is a convolution of the useful signal with the above-described transfer function TM. It follows that there is a need for robust detection methods, which are explained in more detail below.

The methods described below generally are independent of one another and can be used both individually and in combination. Most methods are based on the detection of notches or peaks in the frequency spectrum. There are a number of standard methods for this detection, in which methods either the spectrum itself can be observed with a high-resolution FFT or a plurality of adaptive notch/peak detectors or the like can be used. Use is not made of a specific method in this case; rather, the assumption is made that notch/peak detectors are available, which calculate a type of notch/peak probability.

1. Notch/Peak Spacing:

The aforementioned text alludes to the fact that there is a typical spacing between the notches or the peaks. The spacing results from the overall delay of the closed loop, which delay is usually a sum of the hearing-aid delay and the feedback-path delay. This delay is characteristic of a particular situation and hardly changes. Using this as a starting point, it is proposed to detect successive notches/peaks. If their spacing lies within a certain range, the assumption is made that the notches/peaks originate from the comb-filter effect and not from the useful signal. If the signal is more likely to have notches, the feedback compensator 18 has been adapted well. If it is more likely for peaks to occur, the compensator has been adapted badly. A threshold can be defined for this probability and it can be used to make a decision with respect to increasing the adaptation speed of the feedback compensator or reducing the amplification.

2. Detection in Pauses in the Speech:

It is advantageous to use the notch-peak detection in pauses in the speech only. In the process, the assumption may be made that the current useful signal corresponds to noise, and the detection of a notch directly allows deduction of the fact that the feedback compensation is operating well.

3. Detection in Noisy Frequency Ranges:

Furthermore, it is expedient to utilize the notch detection in noisy frequency ranges. These frequency ranges are not influenced by a useful signal, but only by background noise. It follows that notches in these frequency ranges allow deduction of the fact that the feedback compensation is operating well.

4. Comparison of Detection in the Microphone Input Signal and in the Compensated Output Signal:

It emerges from the aforementioned transfer functions that there usually is a clear difference between the microphone transfer function TM and the compensated transfer function TC. It is proposed that the notch/peak detection be applied to both signals 30, 40 (compare FIG. 2). If a difference is determined during the intended operation of the hearing aid, it is very likely that the feedback compensation generates an appropriate performance. The difference can clearly be identified at 100% compensation in particular (compare FIGS. 3 and 4). If the notches are detected in the spectrum of the microphone signal 30, and there are no corresponding notches in the spectrum of the compensated signal 40, then the feedback compensation is operating as desired.

5. Modulated Notches:

In order to verify that a notch is the result of the comb-filter effect, the output signal can also be subjected to an inaudible phase modulation (or frequency modulation). This phase modulation will lead to a modulation in the notch/peak frequencies. Use can then be made of a suitable notch/peak detector, by means of which the notch/peak frequency can be observed over time. If this frequency has the same modulation frequency as the phase modulation, the comb-filter effect is verified. This method is the most robust in respect of the useful signal.

The aforementioned methods can be used to assess the quality of the feedback adaptation. If the actual feedback path changes and the adapted, simulated feedback path no longer fits, the notches in the signal change to form small peaks. This allows the definition of a suitable threshold, by means of which the feedback path can be optimized before the hearing aid starts to whistle, or by means of which the amplification can be reduced before the aid starts to whistle. Therefore, the advantage of utilizing the comb-filter effect consists of being able to predict the occurrence of feedback whistling before the latter commences. Hence the feedback path can be adapted early enough for preventing the whistling. The invention therefore consists in examining the input signal in respect of contained comb-filter components in order to detect feedback-critical states at an early stage. In order to identify the comb filters unambiguously as the result of the input loudspeaker or receiver signal, a plurality of options have been described above. Probably the most reliable option is a combination made of the conventional so-called "phase shaker", in which use is made of the modulation of the output signal. A modulation is impressed onto the output signal in a conventional fashion, which then leads to an oscillatory motion of the notches in the frequency response of the input signal. Hence a further feature is obtained for identifying feedback.

Figure 11:
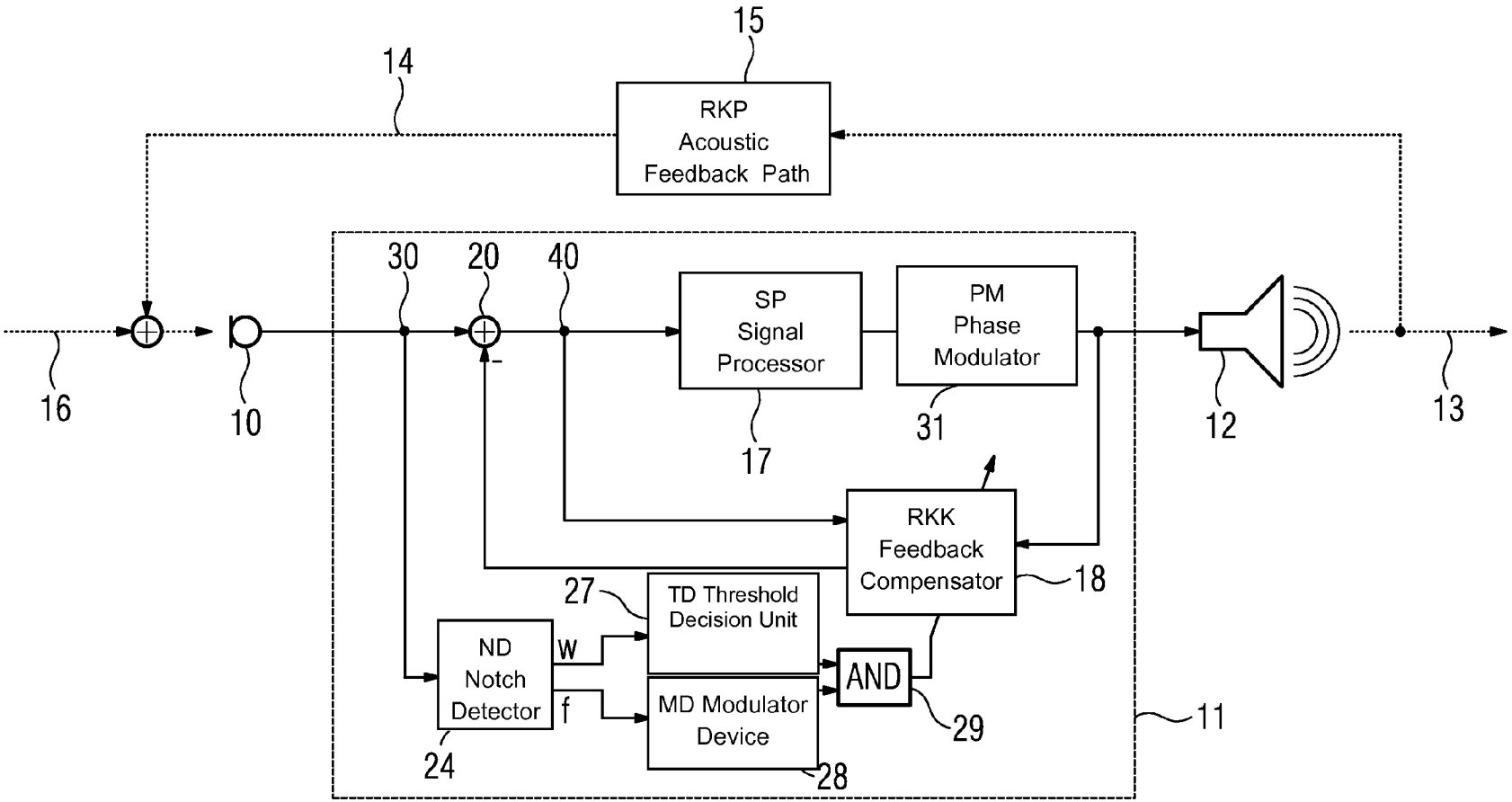
FIG. 11 is a block diagram of a hearing aid according to one embodiment of the present invention.

FIG. 11 shows an implementation of the above-described method for establishing a change in a feedback situation or for adaptation to a changed feedback situation in a hearing aid. The design of the hearing device including the feedback path 15 substantially corresponds to that of FIG. 2. Hence reference is made to the description of FIG. 2 in respect of the components and reference signs that are the same in both figures. In place of the feedback detector 19, the hearing aid in FIG. 11 has a notch detector 24, a threshold-decision unit 27, a modulation detector 28 and an AND-element 29. The notch detector 24 records the microphone signal 30 and establishes a probability w of a notch (i.e. peaked minimum) and the corresponding frequency f of the notch from this. The threshold-decision unit 27 decides whether there is a deviation from the ideal case by comparing the probability w to a threshold. An appropriate output signal is fed to the AND-element 29.

The notch detector 24 feeds the notch frequency f to the modulation detector 28. The latter examines whether the notch frequency f is undergoing an oscillatory motion. An appropriate output signal is guided to the AND-element 29. If the respective conditions are satisfied in the two decision units 27 and 28, the feedback compensator 18 is actuated appropriately by the output signal from the AND-element 29, e.g. the adaptation speed is modified.

In order to verify the feedback situation, the hearing aid has a phase modulator 31 downstream of the signal processor 17, which phase modulator modulates the phase of the output signal to the loudspeaker 12. If there is a feedback situation, the feedback signal 14 likewise is phase-modulated and the modulation over the signal path through the microphone 10 and the notch detector 24 can be registered in the modulation detector 28. If there is a modulation, and the probability of a notch falls below a certain threshold (see FIGS. 5, 7 and 9), the adaptation speed of the feedback compensator is increased.

The invention claimed is:

1. A method for compensating for a feedback signal in a hearing device having an input-transducer apparatus, a signal-processing apparatus and an output-transducer apparatus, which comprises the steps of:

compensating for the feedback signal being fed back to the input-transducer apparatus from the output-transducer apparatus or the signal-processing apparatus;

establishing a probability of having a plurality of notches, equally spaced apart from one another, in a spectrum of an input signal, which originates directly from the input-transducer apparatus or which is a difference signal between a signal directly from the input-transducer apparatus and a compensation signal serving for compensation; and modifying a compensation or an amplification of the signal-processing apparatus in dependence on the probability established.

2. The method according to claim 1, which comprises establishing the probability in a speech phase during an intended operation of the hearing device.

3. The method according to claim 1, wherein a transfer function from the input signal to the output signal corresponds to a comb filter.

4. The method according to claim 1, which further comprises establishing the probability in a noisy frequency range of the input signal.

5. The method according to claim 1, which further comprises verifying the feedback signal by virtue of the fact that an output signal is phase modulated and the notches are analyzed in respect of phase modulation.

6. The method according to claim 1, which further comprises bringing about compensation via an adaptive filter and modifying an adaptation speed in dependence on the probability.

7. The method according to claim 6, which further comprises modifying the compensation to the effect that a transfer function of a compensated signal, created by mixing the input signal with the compensation signal for compensating for the feedback signal, to the output signal is substantially without a gradient in a greatest part of a prescribed spectral range, which should be influenced by the compensation.

8. The method according to claim 1, wherein the notches, equally spaced apart from one another, in the input signal after the input-transducer apparatus are directly compared to same spaced-apart notches in a compensated signal for validating a detection of a feedback situation.

9. A hearing device, comprising:

an input-transducer apparatus;

a signal-processing apparatus for processing an input signal emitted by said input-transducer apparatus to form an output signal;

an output-transducer apparatus for converting the output signal into an acoustic output signal;

a compensation apparatus for compensating for a feedback signal, being fed back to said input-transducer apparatus from said output-transducer apparatus or said signal-processing apparatus;

a detection apparatus for establishing a probability of a spectrum of the input signal having a plurality of notches, equally spaced apart from one another; and said compensation apparatus being controlled in dependence on the probability established.

* * * * *